US012186644B2

(12) United States Patent
Kwak et al.

(10) Patent No.: US 12,186,644 B2
(45) Date of Patent: Jan. 7, 2025

(54) APPARATUS, METHOD AND PROGRAM FOR PROVIDING VIRTUAL CONTROL PANEL

(71) Applicant: Morethings Co., Ltd., Yongin-si (KR)

(72) Inventors: Jae Kyung Kwak, Yongin-si (KR); Kwang Dek An, Hwaseong-si (KR); Ji Won Oh, Gwangju-si (KR); Hwan Il Park, Suwon-si (KR); Jeong Min Han, Seoul (KR)

(73) Assignee: Morethings Co., Ltd., Yongin-si (KR)

( * ) Notice: Subject to any disclaimer, the term of this patent is extended or adjusted under 35 U.S.C. 154(b) by 426 days.

(21) Appl. No.: 17/749,581

(22) Filed: May 20, 2022

(65) Prior Publication Data

US 2023/0201695 A1 Jun. 29, 2023

(30) Foreign Application Priority Data

Dec. 28, 2021 (KR) ..... 10-2021-0190241

(51) Int. Cl.
*A63B 69/36* (2006.01)
*A63B 71/06* (2006.01)

(52) U.S. Cl.
CPC ..... *A63B 71/0622* (2013.01); *A63B 69/3614* (2013.01); *A63B 2071/0638* (2013.01); *A63B 2220/803* (2013.01); *A63B 2220/806* (2013.01)

(58) Field of Classification Search
CPC ..... A63B 71/0622; A63B 69/3614; A63B 2071/0638; A63B 2220/803; A63B 2220/806; A63B 71/0619; A63B 2220/56; A63B 2102/32; A63B 2220/801; A63B 2220/833; A63B 2225/15; A63B 69/3661; A63B 2225/50; A63B 71/04
USPC ..... 473/151, 219, 221–224, 252, 257, 266, 473/269, 278, 409
See application file for complete search history.

(56) References Cited

U.S. PATENT DOCUMENTS 5,419,562 A * 5/1995 Cromarty ..... A63B 24/0003 473/409
6,261,189 B1 * 7/2001 Saville ..... A63B 69/3667 473/266
2003/0017883 A1 * 1/2003 Yoshiike ..... A63B 69/3623 473/269
2007/0196800 A1 * 8/2007 Douthit ..... A63B 69/3667 434/252

FOREIGN PATENT DOCUMENTS

KR 10-1059293 B1 8/2011

* cited by examiner

*Primary Examiner* — Nini F Legesse
(74) *Attorney, Agent, or Firm* — Studebaker & Brackett PC

(57) ABSTRACT

Disclosed is a virtual control panel providing apparatus, method and program providing user convenience such that a user continuously works out by conveniently operating various functions at a current location without movement, by communicating between a golf simulator and a golf mat capable of providing a virtual control panel, providing the virtual control panel, and performing functions of the virtual control panel corresponding to a user input.

14 Claims, 11 Drawing Sheets

APPARATUS, METHOD AND PROGRAM FOR PROVIDING VIRTUAL CONTROL PANEL

CROSS-REFERENCE TO RELATED APPLICATIONS

A claim for priority under 35 U.S.C. § 119 is made to Korean Patent Application No. 10-2021-0190241 filed on Dec. 28, 2021 in the Korean Intellectual Property Office, the entire contents of which are hereby incorporated by reference.

BACKGROUND

Embodiments of the inventive concept described herein relate to an apparatus for providing a virtual control panel, and more particularly, relate to an apparatus, method and program for providing a virtual control panel having system compatibility.

In general, factors that affect the driving distance of golf are the accuracy of a golfer's posture and the head speed of a golf club at an impact.

Accordingly, various golf simulators measure a head speed based on a video by capturing the golfer's posture and a club head at high speed by using a camera and comparing movement amounts between image frames captured at a high speed.

However, these golf simulators may require a high-performance camera and a high-performance signal processing system capable of quickly processing high-speed images. In addition, a user needs to go to a control panel of a system to control the system.

In particular, while the user works out through various functions of a golf simulator, the user stops the workout to operate each function, moves to a system control panel, enters a user input, and works out again. Accordingly, it is difficult for the user to continuously work out, and unnecessary movement time is required to control a panel control.

Accordingly, there is a demand for developing a device that provides a virtual control panel conveniently operating various functions at a current location without movement, and enables continuous workouts, by providing the virtual control panel around the user.

SUMMARY

Embodiments of the inventive concept provide a virtual control panel providing apparatus, method and program that may provide user convenience such that a user continuously works out by conveniently operating various functions at a current location without movement, by communicating between a golf simulator and a golf mat capable of providing a virtual control panel, providing the virtual control panel, and performing functions of the virtual control panel corresponding to a user input.

Problems to be solved by the inventive concept are not limited to the problems mentioned above, and other problems not mentioned will be clearly understood by those skilled in the art from the following description.

According to an embodiment, an apparatus for providing a virtual control panel includes a host being a golf simulator and a client being a golf mat on which a plurality of sensors are arranged. The client includes a communication unit for communicating with the host, a sensor unit for sensing a user input for performing a function of the virtual control panel, storage for storing sensor coordinates and a function, which correspond to the virtual control panel, and a controller for determining the function of the virtual control panel based on sensor coordinates corresponding to the user input. The controller provides identification information indicating the golf mat capable of providing the virtual control panel when communicating with the host, transmits predetermined sensor coordinates and function information of the virtual control panel when an information request for the virtual control panel is received from the host, transmits a notification that the virtual control panel is completely activated, to the host, by activating a sensor corresponding to the virtual control panel, determines whether the sensor coordinates corresponding to the user input received from the sensor unit correspond to the sensor corresponding to the virtual control panel, determines the function of the virtual control panel corresponding to the sensor coordinates when the sensor coordinates correspond to the sensor corresponding to the virtual control panel, and transmits the determined function of the virtual control panel to the host.

According to an embodiment, a method for providing a virtual control panel of an apparatus including a host being a golf simulator and a client being a golf mat on which a plurality of sensors are arranged includes providing, by the client, identification information indicating the golf mat capable of providing the virtual control panel when the client communicates with the host, transmitting, by the client, predetermined sensor coordinates and function information of the virtual control panel when an information request for the virtual control panel is received from the host, activating, by the client, a sensor corresponding to the virtual control panel and transmitting a notification that the virtual control panel is completely activated, to the host, determining, by the client, whether the sensor coordinates corresponding to the user input correspond to the sensor corresponding to the virtual control panel when a user input is received from the sensor, determining, by the client, a function of the virtual control panel corresponding to the sensor coordinates when the sensor coordinates correspond to the sensor corresponding to the virtual control panel, and transmitting, by the client, the determined function of the virtual control panel to the host.

In addition, another method and another system for implementing the inventive concept, and a computer-readable recording medium for recording a computer program for performing the method may be further provided.

BRIEF DESCRIPTION OF THE FIGURES

The above and other objects and features will become apparent from the following description with reference to the following figures, wherein like reference numerals refer to like parts throughout the various figures unless otherwise specified, and wherein.

DETAILED DESCRIPTION

Figure 1:
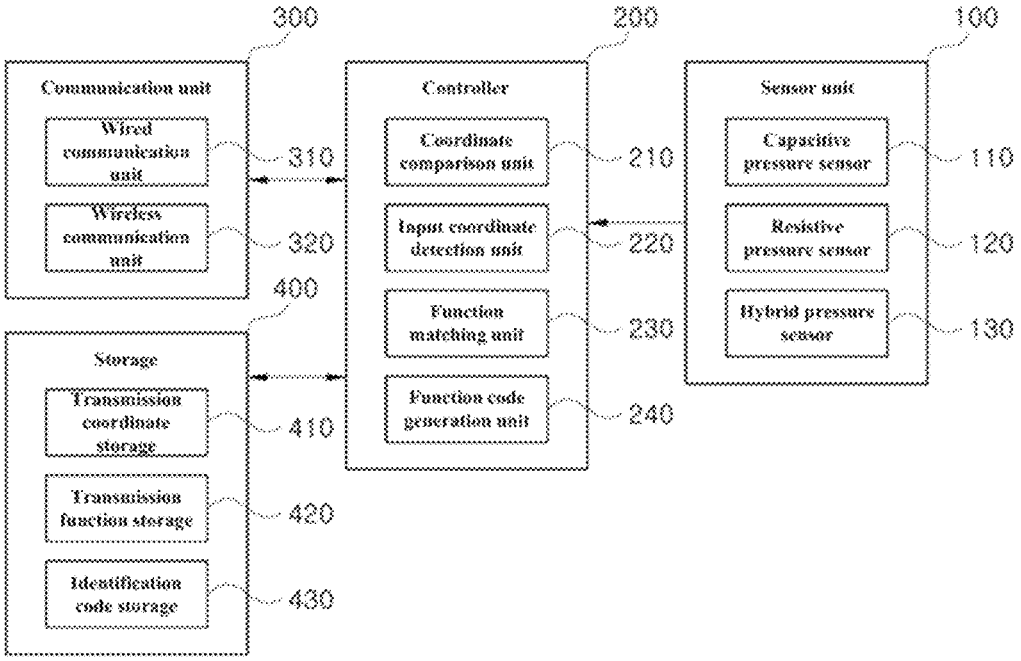
FIG. 1 is a block diagram illustrating an apparatus for providing a virtual control panel, according to an embodiment of the inventive concept.

The above and other aspects, features and advantages of the inventive concept will become apparent from the following description of the following embodiments given in conjunction with the accompanying drawings. The inventive concept, however, may be embodied in various different forms, and should not be construed as being limited only to the illustrated embodiments. Rather, these embodiments are provided as examples so that the inventive concept will be thorough and complete, and will fully convey the scope of the inventive concept to those skilled in the art. The inventive concept may be defined by the scope of the claims.

The terms used herein are provided to describe embodiments, not intended to limit the inventive concept. In the specification, the singular forms include plural forms unless particularly mentioned. The terms "comprises" and/or "comprising" used herein do not exclude the presence or addition of one or more other components, in addition to the aforementioned components. The same reference numerals denote the same components throughout the specification. As used herein, the term "and/or" includes each of the associated components and all combinations of one or more of the associated components. It will be understood that, although the terms "first", "second", etc., may be used herein to describe various components, these components should not be limited by these terms. These terms are only used to distinguish one component from another component. Thus, a first component that is discussed below could be termed a second component without departing from the technical idea of the inventive concept.

Unless otherwise defined, all terms (including technical and scientific terms) used herein have the same meaning as commonly understood by those skilled in the art to which the inventive concept pertains. The terms, such as those defined in commonly used dictionaries, should not be interpreted in an idealized or overly formal sense unless expressly so defined herein.

Hereinafter, an embodiment of the inventive concept will be described in detail with reference to the accompanying drawings.

Prior to a description, the meaning of terms used in the present specification will be described briefly. However, because the description of terms is used to help the understanding of this specification, it should be noted that if the inventive concept is not explicitly described as a limiting matter, it is not used in the sense of limiting the technical idea of the inventive concept.

FIG. 1 is a block diagram illustrating an apparatus for providing a virtual control panel, according to an embodiment of the inventive concept.

As illustrated in FIG. 1, an apparatus for providing a virtual control panel according to an embodiment of the inventive concept may include a host including a golf simulator and a client including a golf mat on which a plurality of sensors are arranged.

Here, the client may include a communication unit 300 for communicating with the host, a sensor unit 100 for sensing a user input for performing a virtual control panel function, storage 400 for storing sensor coordinates and functions corresponding to the virtual control panel, and a controller 200 for determining the virtual control panel function based on the sensor coordinates corresponding to the user input.

The communication unit 300 may include a wired communication unit 310 connected to the host by wire and a wireless communication unit 320 wirelessly connected to the host.

Moreover, the storage 400 may include transmission coordinate storage 410 for storing predetermined sensor coordinates of a virtual control panel, transmission function storage 420 for storing predetermined function information of the virtual control panel, and identification code storage 430 for storing an identification code indicating that the client is a golf mat capable of providing the virtual control panel.

Here, in the sensor unit 100, a plurality of sensors may be arranged one-dimensionally or two-dimensionally on a mat plate.

Here, each of the plurality of sensors may be a single sensor including one of a pressure-sensitive sensor, a capacitive sensor, a switch-type sensor, an electromagnetic induction sensor, and a near-infrared sensor. Alternatively, each of the plurality of sensors may be a composite sensor including two or more among a pressure-sensitive sensor, a capacitive sensor, a switch-type sensor, an electromagnetic induction sensor, and a near-infrared sensor.

In addition, the sensor unit 100 may be positioned between an upper mat plate including a grass finishing material and a lower mat plate.

For example, each of the plurality of sensors may be a single sensor including one of a capacitive pressure sensor 110, a resistive pressure sensor 120, and a hybrid pressure sensor 130. Alternatively, each of the plurality of sensors may be a composite sensor including two or more among the capacitive pressure sensor 110, the resistive pressure sensor 120, and the hybrid pressure sensor 130.

In an embodiment, in the sensor unit 100, single sensors, each of which includes one of the capacitive pressure sensor 110, the resistive pressure sensor 120, and the hybrid pressure sensor 130, may be arranged one-dimensionally or two-dimensionally on the mat plate.

Here, the single sensors may be arranged at equal intervals in lateral and longitudinal directions of the mat plate.

In some cases, the single sensors may be arranged at unequal intervals in the lateral direction of the mat plate and may be arranged at equal intervals in the longitudinal direction of the mat plate.

Here, the single sensors arranged in the lateral direction may be arranged such that an interval between the single sensors gradually narrows from one side of the mat plate to a center area of the mat plate and then gradually widens from the center area to the other side.

In another embodiment, in the sensor unit 100, a first sensor group including a plurality of capacitive pressure sensors and a second sensor group including a plurality of resistive pressure sensors may be arranged one-dimensionally on a mat plate. Alternatively, the first sensor group including a plurality of capacitive pressure sensors and the second sensor group including a plurality of resistive pressure sensors may be arranged two-dimensionally on the mat plate.

Here, the capacitive pressure sensors of the first sensor group are arranged at an upper portion of the mat plate to sense the trajectory of a golf club head. The resistive pressure sensors of the second sensor group are arranged at a lower portion of the mat plate to sense a pressure corresponding to the user's golf posture. In this case, the golf club according to an embodiment of the inventive concept may include at least one of a driver, a plurality of woods (e.g., 3-wood to 5-wood, or the like), a plurality of utilities (e.g., 3-utility to 5-utility, or the like), and a plurality of irons (e.g., 3-iron to 9-iron, pitching wedges, sand wedges, or the like). According to an embodiment of the inventive concept, in a golf club of which the swing speed is measured, one of the above-mentioned clubs may be set as default or the setting thereof may be changed by the user. In the following description, it is assumed that the golf club is a "driver". The inventive concept is not limited thereto, and it is obvious that the inventive concept is capable of being applied not only to the "driver" but also to all the clubs described above.

At this time, the capacitive pressure sensors of the first sensor group may be arranged at equal intervals in the lateral direction and the longitudinal direction at the upper portion of the mat plate. The resistive pressure sensors of the second sensor group may be arranged at equal intervals in the lateral direction and the longitudinal direction at the lower portion of the mat plate.

Furthermore, an interval between the capacitive pressure sensors arranged in the lateral direction may be the same as an interval between the resistive pressure sensors arranged in the lateral direction. An interval between the capacitive pressure sensors arranged in the longitudinal direction may be the same as an interval between the resistive pressure sensors arranged in the longitudinal direction.

In some cases, the capacitive pressure sensors of the first sensor group may be arranged at unequal intervals in the lateral direction at the upper portion of the mat plate and may be arranged at equal intervals in the longitudinal direction at the upper portion of the mat plate. The resistive pressure sensors of the second sensor group may be arranged at equal intervals in the lateral direction and the longitudinal direction at the lower portion of the mat plate.

Here, an interval between the capacitive pressure sensors arranged in the lateral direction may be different from an interval between the resistive pressure sensors arranged in the lateral direction. An interval between the capacitive pressure sensors arranged in the longitudinal direction may be the same as an interval between the resistive pressure sensors arranged in the longitudinal direction.

For example, the capacitive pressure sensors arranged in the lateral direction may be arranged such that an interval between the capacitive pressure sensors gradually narrows from one side of the upper portion of the mat plate to a center area of the upper portion of the mat plate and then gradually widens from the center area to the other side.

Moreover, the number of capacitive pressure sensors of the first sensor group may be less than the number of resistive pressure sensors of the second sensor group.

The number of capacitive pressure sensors in the first sensor group that measures the driver's speed is not needed to be greater than the number of resistive pressure sensors in the second sensor group that measures a user's golf posture. This is to make a mat compact such that the user is capable of conveniently transporting the mat, by minimizing the size of the mat by using the smallest sensor.

In another embodiment, in the sensor unit 100, a first sensor group including a plurality of capacitive pressure sensors may be arranged one-dimensionally on a mat plate; and, a second sensor group including a plurality of resistive pressure sensors may be arranged two-dimensionally on the mat plate. Alternatively, the first sensor group including a plurality of capacitive pressure sensors may be arranged two-dimensionally on the mat plate; and, and the second sensor group including a plurality of resistive pressure sensors may be arranged one-dimensionally on the mat plate.

Here, the capacitive pressure sensors of the first sensor group are arranged at an upper portion of the mat plate to sense the trajectory of a driver head. The resistive pressure sensors of the second sensor group are arranged at a lower portion of the mat plate to sense a pressure corresponding to the user's golf posture.

Also, the capacitive pressure sensors of the first sensor group may be arranged at equal intervals in the lateral direction and the longitudinal direction at the upper portion of the mat plate. The resistive pressure sensors of the second sensor group may be arranged at equal intervals in the lateral direction and the longitudinal direction at the lower portion of the mat plate.

Here, an interval between the capacitive pressure sensors arranged in the lateral direction may be the same as an interval between the resistive pressure sensors arranged in the lateral direction. An interval between the capacitive pressure sensors arranged in the longitudinal direction may be the same as an interval between the resistive pressure sensors arranged in the longitudinal direction.

In some cases, the capacitive pressure sensors of the first sensor group may be arranged at unequal intervals in the lateral direction at the upper portion of the mat plate and may be arranged at equal intervals in the longitudinal direction at the upper portion of the mat plate. The resistive pressure sensors of the second sensor group may be arranged at equal intervals in the lateral direction and the longitudinal direction at the lower portion of the mat plate.

Here, an interval between the capacitive pressure sensors arranged in the lateral direction may be different from an interval between the resistive pressure sensors arranged in the lateral direction. An interval between the capacitive pressure sensors arranged in the longitudinal direction may be the same as an interval between the resistive pressure sensors arranged in the longitudinal direction.

At this time, the capacitive pressure sensors arranged in the lateral direction may be arranged such that an interval between the capacitive pressure sensors gradually narrows from one side of the upper portion of the mat plate to a center area of the upper portion of the mat plate and then gradually widens from the center area to the other side.

Moreover, the number of capacitive pressure sensors of the first sensor group may be less than the number of resistive pressure sensors of the second sensor group.

Besides, the capacitance of the capacitive pressure sensor 110 of the sensor unit 100 may be changed depending on the user's pressure; the resistance of the resistive pressure sensor 120 of the sensor unit 100 may be changed depending on the user's pressure; and, the capacitance and resistance of the hybrid pressure sensor 130 of the sensor unit 100 may be changed depending on the user's pressure.

Next, the controller 200 may include a coordinate comparison unit 210 for comparing sensor coordinates of a user input with predetermined sensor coordinates of a virtual control panel, an input coordinate detection unit 220 for detecting the sensor coordinates corresponding to the user input when the user input is received from the sensor unit 100, a function matching unit 230 for matching a function of the virtual control panel to the sensor coordinates of the user input when the sensor coordinates corresponding to the user input corresponds to a sensor corresponding to the virtual control panel, and a function code generation unit 240 for generating an execution code for executing the corresponding function when a function of the virtual control panel is matched.

Here, the controller 200 may provide identification information indicating a golf mat capable of providing a virtual control panel when communicating with the host, may transmit predetermined sensor coordinates and function information of the virtual control panel when receiving an information request for the virtual control panel from the host, may transmit a notification that the virtual control panel is completely activated, to the host by activating a sensor corresponding to the virtual control panel, may determine whether the sensor coordinates corresponding to the user input received from the sensor unit 100 correspond to the sensor corresponding to the virtual control panel, may determine a function of the virtual control panel corresponding to the sensor coordinates, and may transmit the determined virtual control panel function to the host when the sensor coordinates correspond to the sensor corresponding to the virtual control panel.

Moreover, the controller 200 may identify a communication connection with the host when providing the identification information, may determine whether the identification information indicating a golf mat capable of providing a virtual control panel is stored in the storage 400, may obtain the identification information from the storage 400 when the identification information is stored in the storage 400, and may allow the communication unit 300 to transmit the identification information to the host.

Here, the controller 200 may request the identification information from an external server through the communication unit 300 when the identification information is not stored in the storage 400, may allow the storage 400 to store the identification information received from an external server, and may allow the communication unit 300 to transmit the received identification information to the host.

Next, the controller 200 may determine whether an information request for a virtual control panel is received from the host, when transmitting the sensor coordinates and function information of the virtual control panel, may determine whether the sensor coordinates and function information of the virtual control panel are stored in the storage 400, when the information request for the virtual control panel is received, may obtain the sensor coordinates and function information of the virtual control panel from the storage 400 when the sensor coordinates and function information of the virtual control panel are stored in the storage 400, and may allow the communication unit 300 to transmit the sensor coordinates and the function information to the host.

Here, the controller 200 may make a request for the sensor coordinates and function information of the virtual control panel to an external server through the communication unit 300 when the sensor coordinates and function information of the virtual control panel are not stored in the storage 400, may allow the storage 400 to store the sensor coordinates and function information of the virtual control panel received from the external server, and may allow the communication unit 300 to transmit the received sensor coordinates and function information of the virtual control panel to the host.

Furthermore, when transmitting the sensor coordinates and function information of the virtual control panel, the controller 200 may transmit coordinate information about one sensor corresponding to the virtual control panel and setting function information thereof to the host, or may transmit, to the host, a coordinate range including coordinate information of a sensor located at a start point and coordinate information of a sensor located at an end point, and setting function information corresponding to the corresponding sensor group in a sensor group including a plurality of sensors corresponding to the virtual control panel.

For example, the coordinate information of a sensor may be at least one of an X coordinate, a Y coordinate, and an XY coordinate.

In some cases, when there are a plurality of sensor groups corresponding to the virtual control panel, the controller 200 may transmit, to the host, the coordinate information of a start point position sensor and the coordinate information of an end point position sensor for all sensor groups corresponding to the virtual control panel and may transmit, to the host, all setting function information corresponding to all corresponding sensor groups.

Here, a plurality of sensor groups may include pieces of setting function information different from one another.

For example, the number of sensor groups may be the same as the number of setting functions.

In some cases, the number of sensor groups may be greater than the number of setting functions.

Here, sensor groups having the same setting function may be symmetrically positioned on left and right sides of a golf mat.

For example, a sensor group positioned on the left side of the golf mat may be a virtual control panel for left-handed users. The sensor group positioned to the right of the golf mat may be a virtual control panel for right-handed users.

Next, when the controller 200 receives an information request for a specific function of a virtual control panel from a host, the controller 200 may obtain the sensor coordinates and detailed function information of the virtual control panel corresponding to a specific function from the storage 400 when transmitting the sensor coordinates and function information of the virtual control panel, and may allow the communication unit 300 to transmit the sensor coordinates and detailed function information to the host.

Next, when the controller 200 determines whether a sensor corresponds to the virtual control panel, the controller 200 may identify the sensor coordinates corresponding to a user input when the user input is received from the sensor unit 100, may compare sensor coordinates of a user input with predetermined sensor coordinates of the virtual control panel, and may recognize that a sensor corresponding to the sensor coordinates of the user input is a sensor corresponding to the virtual control panel when the sensor coordinates of the user input correspond to one of sensor coordinates of the virtual control panel.

Moreover, when the controller 200 determines a function of the virtual control panel, the controller 200 may determine whether the function of the virtual control panel is set for the sensor coordinates of the user input, when the sensor coordinates corresponding to the user input correspond to a sensor corresponding to the virtual control panel, and may generate an execution code for executing the corresponding function when the function of the virtual control panel is set.

As such, the inventive concept may provide user convenience such that a user continuously works out by conveniently operating various functions at a current location without movement, by communicating between a golf simulator and a golf mat capable of providing a virtual control panel, providing the virtual control panel, and performing functions of the virtual control panel corresponding to a user input.

The inventive concept may provide compatibility indicating that a connection to a golf simulator provided by a plurality of manufacturers is possible, by providing a physical control panel of a golf simulator as a virtual button on a golf mat and may set the location and function of the virtual button on the golf mat such that a separate production process and a design change are not needed.

Moreover, when communication with the golf simulator is connected, the set coordinates and function may be finally determined by recognizing identifiers to be exchanged.

Figure 2:
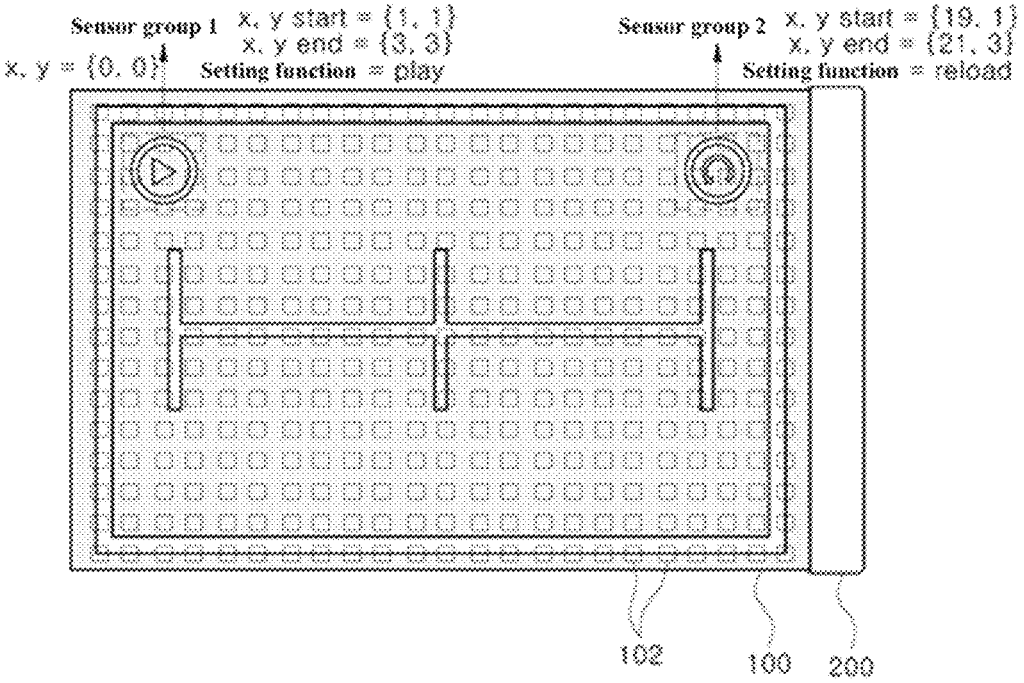
FIG. 2 is a diagram for describing settings of a sensor group and sensor coordinates of the sensor unit of FIG. 1.

FIG. 2 is a diagram for describing settings of a sensor group and sensor coordinates of the sensor unit of FIG. 1.

As shown in FIG. 2, in a sensor unit 100 according to an embodiment of the inventive concept, a plurality of sensors 102 may be arranged one-dimensionally or two-dimensionally on a mat plate.

Here, each of the plurality of sensors 120 may be a single sensor including one of a pressure-sensitive sensor, a capacitive sensor, a switch-type sensor, an electromagnetic induction sensor, and a near-infrared sensor. Alternatively, each of the plurality of sensors 120 may be a composite sensor including two or more among a pressure-sensitive sensor, a capacitive sensor, a switch-type sensor, an electromagnetic induction sensor, and a near-infrared sensor.

According to an embodiment of the inventive concept, the controller 200 may transmit coordinate information about the one sensor 120 corresponding to the virtual control panel and setting function information thereof to the host, or may transmit, to the host, a coordinate range including coordinate information of a sensor located at a start point and coordinate information of a sensor located at an end point, and setting function information corresponding to the corresponding sensor group in a sensor group including the plurality of sensors 102 corresponding to the virtual control panel.

For example, the coordinate information of a sensor may be at least one of an X coordinate, a Y coordinate, and an XY coordinate.

As shown in FIG. 2, according to an embodiment of the inventive concept, when the plurality of sensors 102 are arranged two-dimensionally on the mat plate, XY coordinates for the first sensor in the left corner region may be {0, 0}.

Moreover, according to an embodiment of the inventive concept, among the plurality of sensors 102 included in the first sensor group corresponding to the virtual control panel, the XY coordinates for the sensor located at a start point in the first sensor group are {1, 1}, and the XY coordinates for the sensor located at an end point in the first sensor group are {3, 3}. The setting function of the first sensor group corresponding to the coordinate range including the XY coordinates for each of the sensors located at the start point and the end point may be set to "play".

Accordingly, according to an embodiment of the inventive concept, when a user input is sensed from the plurality of sensors 102 included in the first sensor group, a host may recognize a user input as a play function and may perform the play function by transmitting, to the host, the sensor coordinates information corresponding to the virtual control panel and play function information corresponding to the sensor coordinates information.

Besides, according to an embodiment of the inventive concept, among the plurality of sensors 102 included in the second sensor group corresponding to the virtual control panel, the XY coordinates for the sensor located at a start point in the second sensor group are {19, 1}, and the XY coordinates for the sensor located at an end point in the second sensor group are {21, 3}. The setting function of the first sensor group corresponding to the coordinate range including the XY coordinates for each of the sensors located at the start point and the end point may be set to "reload".

Accordingly, according to an embodiment of the inventive concept, when a user input is sensed from the plurality of sensors 102 included in the second sensor group, a host may recognize a user input as a reload function and may perform the reload function by transmitting, to the host, the sensor coordinates information corresponding to the virtual control panel and reload function information corresponding to the sensor coordinates information.

Figure 3:
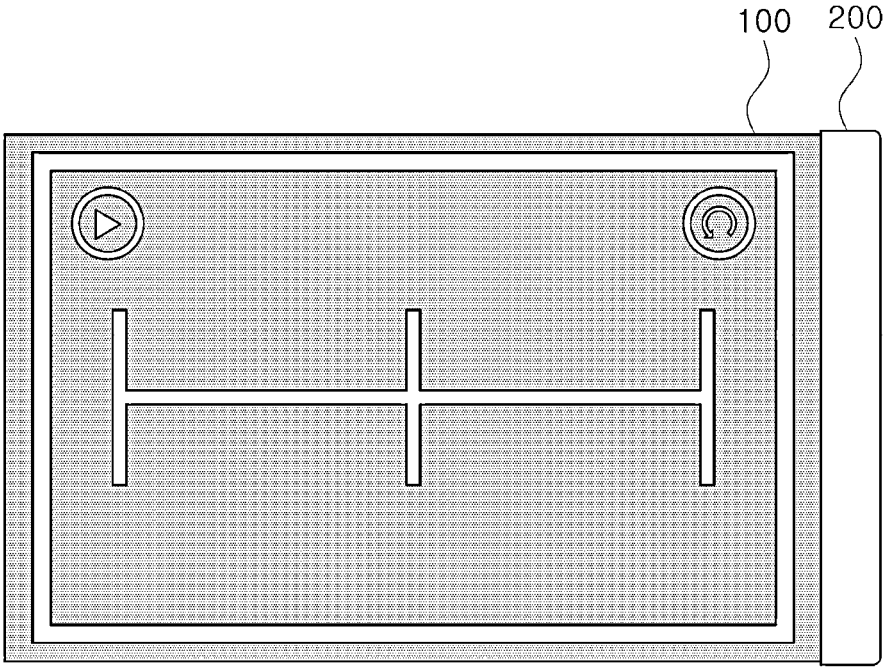
FIGS. 3 to 4 are diagrams for describing a structure of the sensor unit of FIG. 1.
Figure 4:
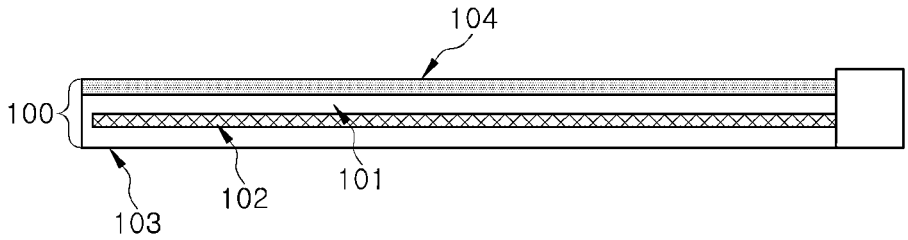

FIGS. 3 to 4 are diagrams for describing a structure of the sensor unit of FIG. 1.

FIG. 3 is a plan view of a sensor unit. FIG. 4 is a cross-sectional view of the sensor unit.

As shown in FIGS. 3 and 4, the sensor unit 100 may include the plurality of sensors 102 between an upper mat plate 101, which includes a grass finishing material 104, and a lower mat plate 103.

In addition, the controller 200 may be positioned on one side of the sensor unit 100.

Here, the controller 200 may provide identification information indicating a golf mat capable of providing a virtual control panel when communicating with a golf simulator, may transmit predetermined sensor coordinates and function information of the virtual control panel when receiving an information request for the virtual control panel from the golf simulator, may transmit a notification that the virtual control panel is completely activated, to the golf simulator by activating a sensor corresponding to the virtual control panel, may determine whether the sensor coordinates corresponding to the user input received from the sensor unit 100 correspond to the sensor corresponding to the virtual control panel, may determine a function of the virtual control panel corresponding to the sensor coordinates, and may transmit the determined virtual control panel function to the golf simulator when the sensor coordinates correspond to the sensor corresponding to the virtual control panel.

As such, the inventive concept may provide user convenience such that a user continuously works out by conveniently operating various functions at a current location without movement, by communicating between a golf simulator and a golf mat capable of providing a virtual control panel, providing the virtual control panel, and performing functions of the virtual control panel corresponding to a user input.

That is, the inventive concept may provide compatibility indicating that a connection to a golf simulator provided by a plurality of manufacturers is possible, by providing a physical control panel of a golf simulator as a virtual button on a golf mat and may set the location and function of the virtual button on the golf mat such that a separate production process and a design change are not needed.

Moreover, when communication with the golf simulator is connected, the set coordinates and function may be finally determined by recognizing identifiers to be exchanged.

FIGS. 5 to 9 are diagrams for describing a sensor operation structure of a sensor unit of FIG. 1.

As shown in FIGS. 5 to 9, in a sensor unit according to an embodiment of the inventive concept, a plurality of sensors may be arranged one-dimensionally or two-dimensionally on a mat plate.

Here, each of the plurality of sensors may be a single sensor including one of a pressure-sensitive sensor, a capacitive sensor, a switch-type sensor, an electromagnetic induction sensor, and a near-infrared sensor. Alternatively, each of the plurality of sensors may be a composite sensor including two or more among a pressure-sensitive sensor, a capacitive sensor, a switch-type sensor, an electromagnetic induction sensor, and a near-infrared sensor.

Figure 5:
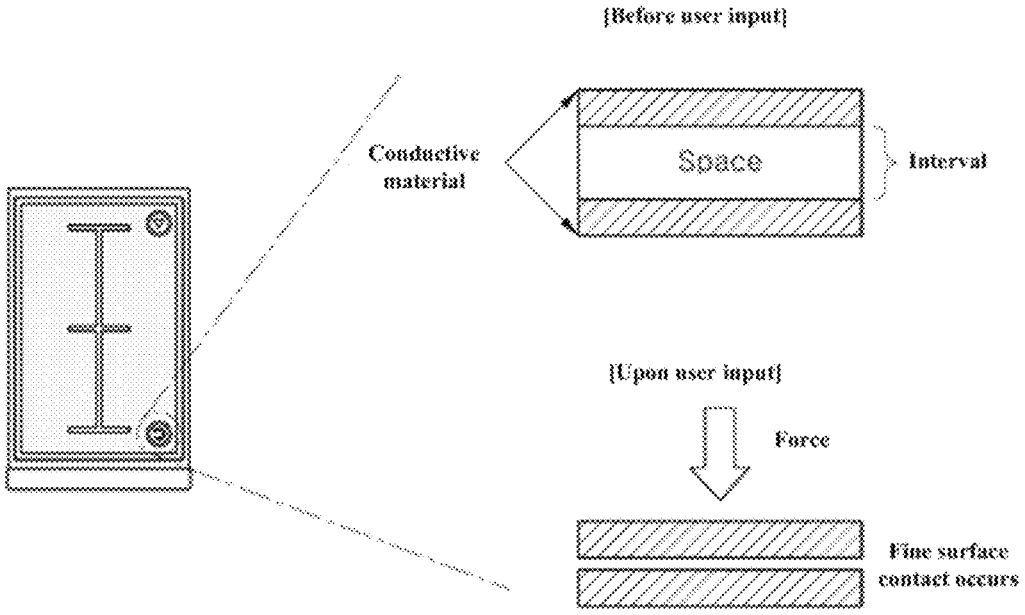
FIGS. 5 to 9 are diagrams for describing a sensor operation structure of a sensor unit of FIG. 1.

As illustrated in FIG. 5, an upper conductor and a lower conductor, each of which is formed of a conductive material, may be disposed in the pressure-sensitive sensor. A space may be formed between the upper conductor and the lower conductor such that the upper conductor and the lower conductor have a predetermined interval.

Moreover, the pressure-sensitive sensor may sense a user input by a user's pressure when the upper conductor finely contacts the lower conductor.

Figure 6:
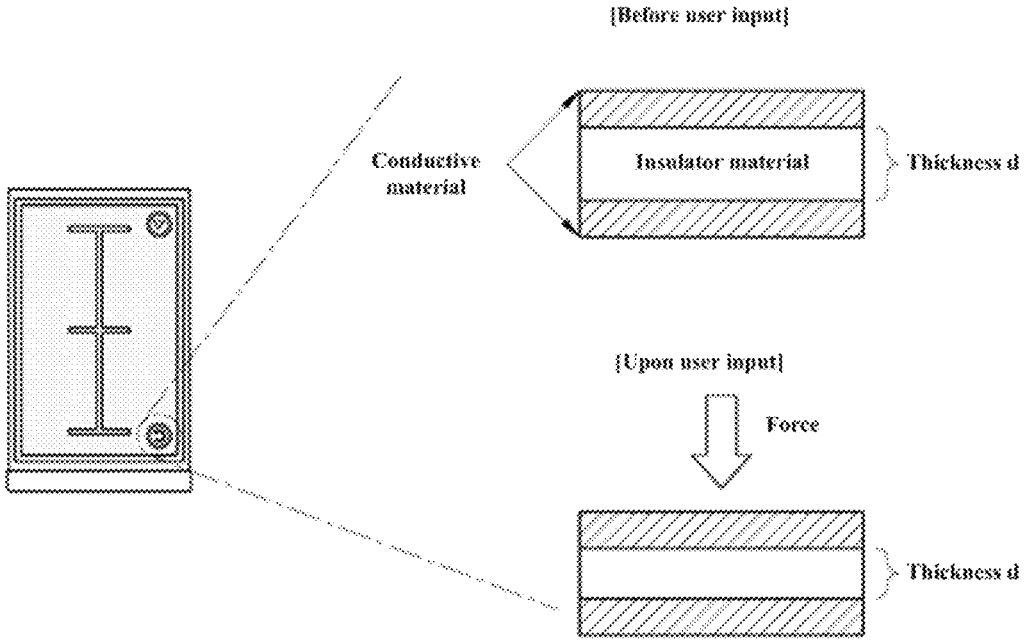

Furthermore, as illustrated in FIG. 6, an upper conductor and a lower conductor, each of which is formed of a conductive material, may be disposed in the capacitive sensor. An insulator having a predetermined thickness 'd' may be interposed between the upper conductor and the lower conductor such that the upper conductor and the lower conductor have a predetermined interval.

Besides, the capacitive sensor may sense a user input by changing the thickness 'd' of the insulator between the upper conductor and the lower conductor by the user's pressure.

Figure 7:
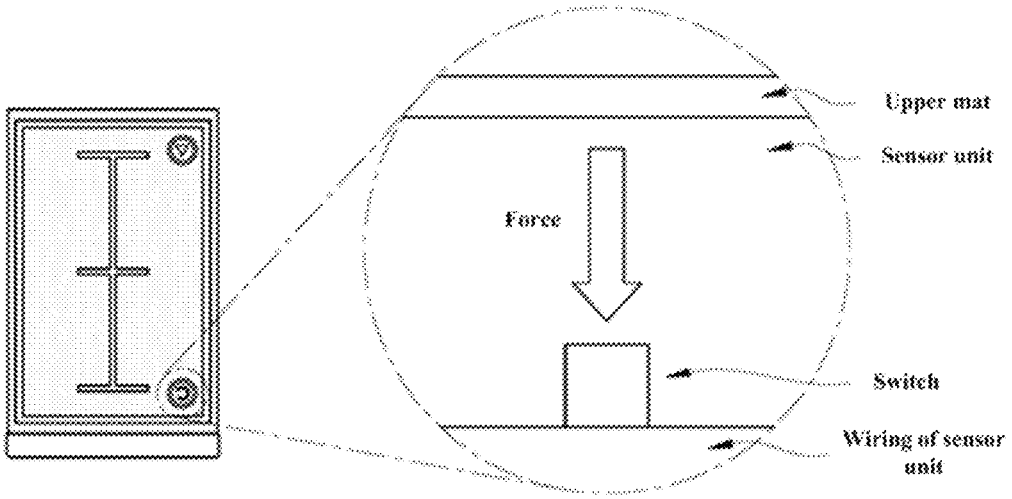

In addition, as shown in FIG. 7, the switch-type sensor may be disposed in a sensor unit between the upper mat and the lower mat while a switch is electrically connected to the wiring of the sensor unit.

Also, the switch-type sensor may sense a user input by pressing the switch positioned on the sensor unit of the upper mat by the user's pressure.

Figure 8:
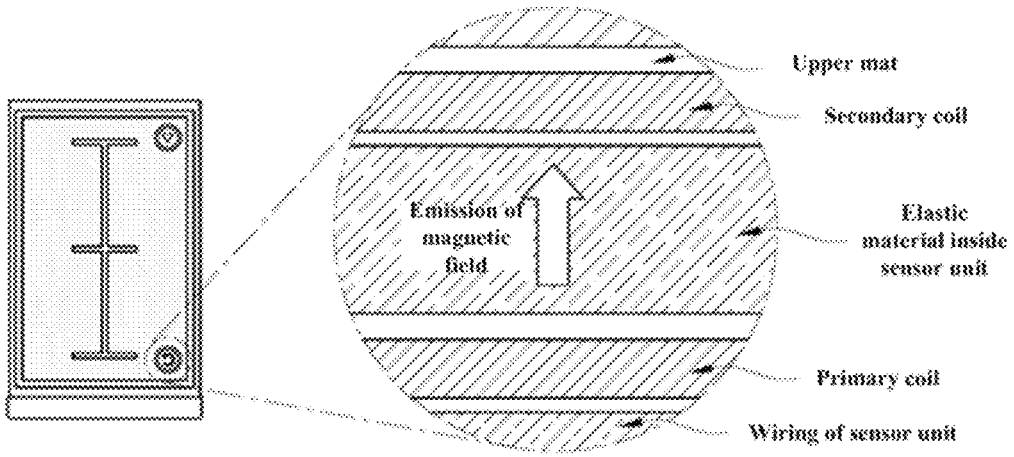

Moreover, as illustrated in FIG. 8, a secondary coil positioned under the upper mat and a primary coil positioned on the wiring of the sensor unit of the lower mat may be disposed in the electromagnetic induction sensor. An internal elastic body made of an elastic material having the predetermined thickness 'd' may be interposed between the secondary coil and the primary coil such that the secondary coil and the primary coil have a predetermined interval.

Furthermore, an induced current may be generated by changing the thickness 'd' of an inner elastic body between the secondary coil and the primary coil by the user's pressure. Accordingly, the electromagnetic induction sensor may sense a user input.

Figure 9:
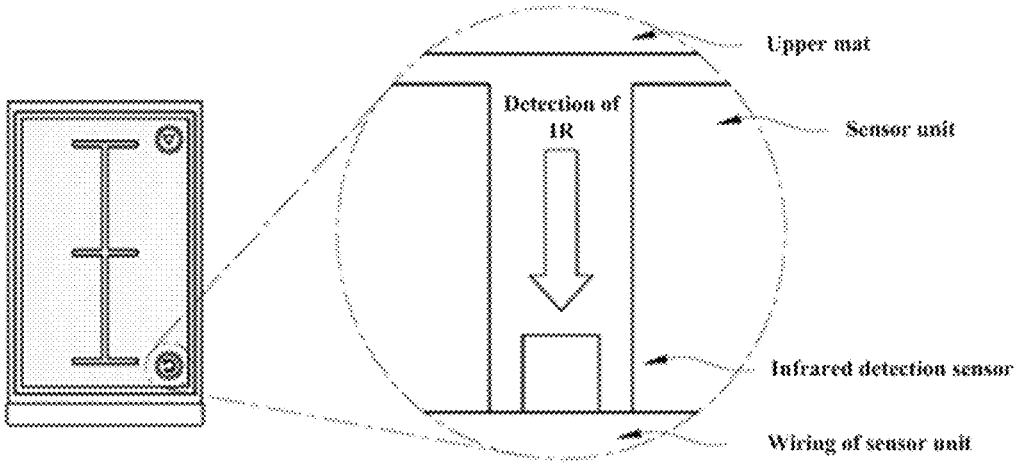

In addition, as shown in FIG. 9, the near-infrared sensor may be disposed in the sensor unit between the upper mat and the lower mat while an infrared detection sensor is electrically connected to the wiring of the sensor unit.

Besides, the switch-type sensor may sense a user input as the infrared detection sensor detects infrared rays generated in response to the user input.

Figure 10:
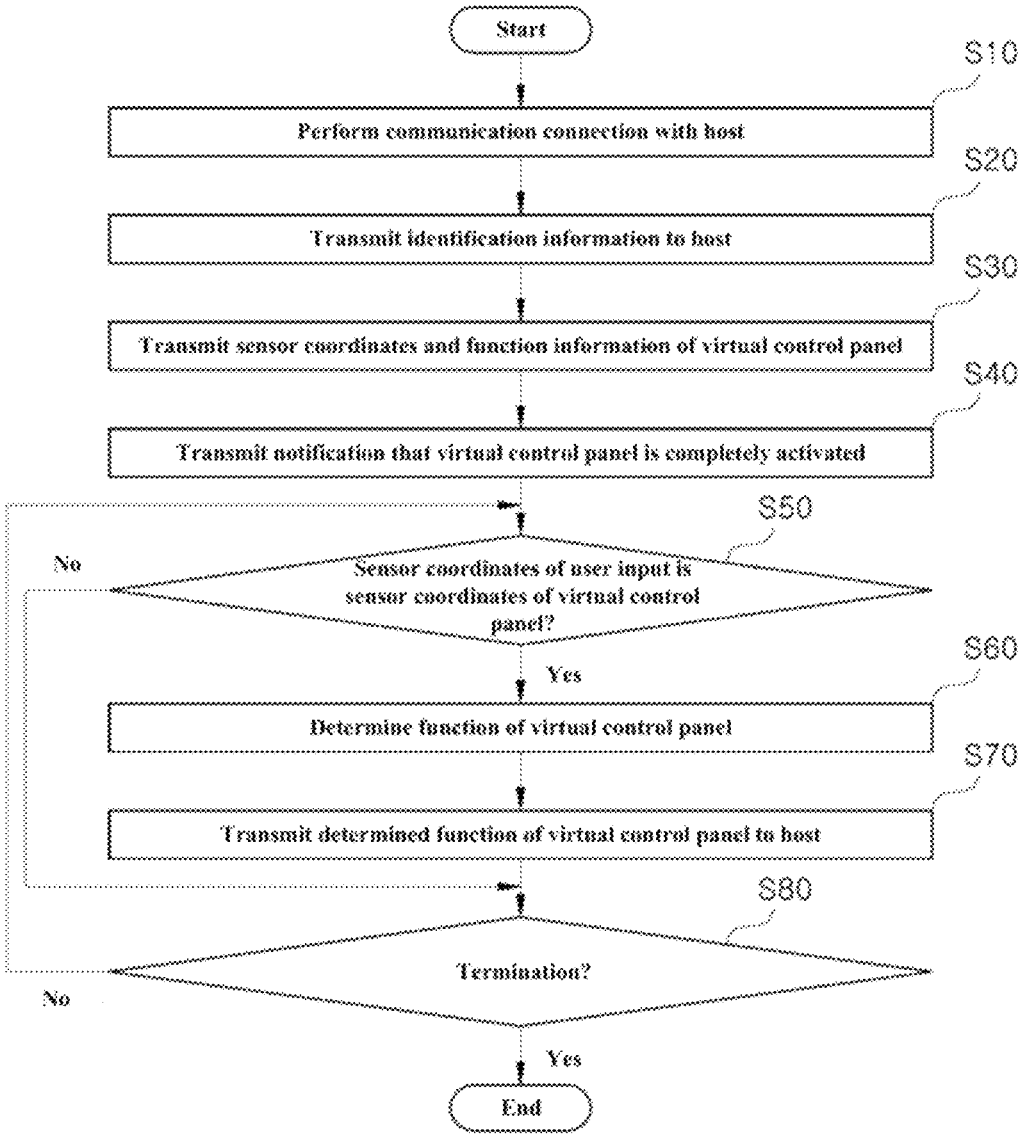
FIGS. 10 and 11 are flowcharts for describing a method of providing a virtual control panel, according to an embodiment of the inventive concept.
Figure 11:
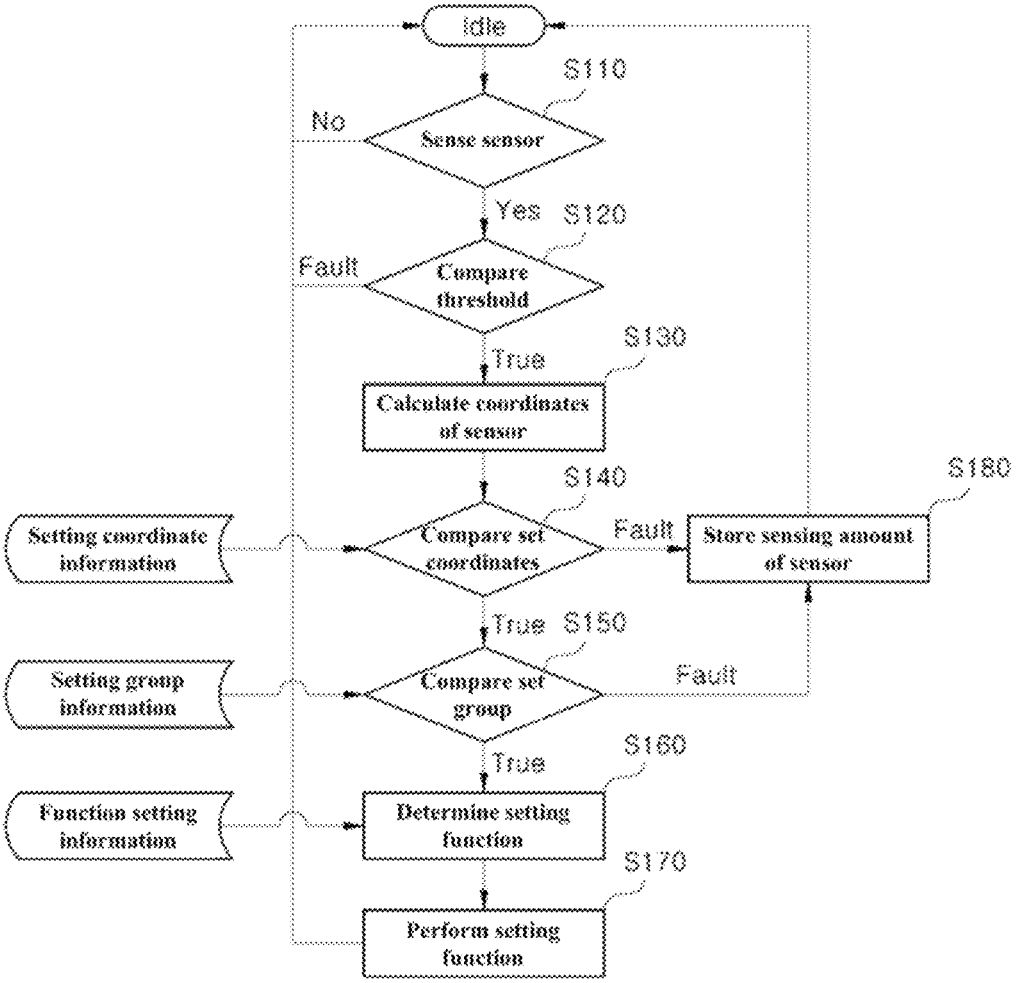

FIGS. 10 and 11 are flowcharts for describing a method of providing a virtual control panel, according to an embodiment of the inventive concept.

As illustrated in FIG. 10, according to an embodiment of the inventive concept, a client that is a golf mat, on which a plurality of sensors are arranged, may perform a communication connection with a host that is a golf simulator (S10).

Next, the client according to an embodiment of the inventive concept may provide identification information indicating a golf mat capable of providing a virtual control panel, when performing the communication connection with the host (S20).

Here, the client according to an embodiment of the inventive concept may identify the communication connection with the host, may determine whether the identification information indicating the golf mat capable of providing the virtual control panel is stored in the storage, when the communication connection with the host is completed, may obtain the identification information from storage when the identification information is stored in storage, and may transmit the identification information to the host.

Next, the client according to an embodiment of the inventive concept may transmit predetermined sensor coordinates and function information of the virtual control panel when receiving an information request for the virtual control panel from the host (S30).

Here, the client according to an embodiment of the inventive concept may determine whether the information request for the virtual control panel is received from the host, may determine whether the sensor coordinates and function information of the virtual control panel are stored in the storage, when the information request for the virtual control panel is received, may obtain the sensor coordinates and function information of the virtual control panel from the storage when the sensor coordinates and function information of the virtual control panel are stored in the storage, and may transmit the sensor coordinates and the function information to the host.

Moreover, the client according to an embodiment of the inventive concept may transmit coordinate information about one sensor corresponding to the virtual control panel and setting function information thereof to the host, or may transmit, to the host, a coordinate range including coordinate information of a sensor located at a start point and coordinate information of a sensor located at an end point, and setting function information corresponding to the corresponding sensor group in a sensor group including the plurality of sensors corresponding to the virtual control panel.

In addition, the client according to an embodiment of the inventive concept may activate the sensor corresponding to the virtual control panel and may transmit a notification that the virtual control panel is completely activated, to the host (S40).

Next, the client according to an embodiment of the inventive concept may determine whether the sensor coordinates corresponding to the user input correspond to the sensor corresponding to the virtual control panel when receiving a user input from the sensor (S50).

Here, the client according to an embodiment of the inventive concept may identify the sensor coordinates corresponding to a user input when the user input is received from the sensor unit, may compare sensor coordinates of a user input with predetermined sensor coordinates of the virtual control panel, and may recognize that a sensor corresponding to the sensor coordinates of the user input is a sensor corresponding to the virtual control panel when the sensor coordinates of the user input correspond to one of sensor coordinates of the virtual control panel.

Next, the client according to an embodiment of the inventive concept may determine a function of the virtual control panel corresponding to the sensor coordinates when the sensor coordinates correspond to a sensor corresponding to the virtual control panel (S60).

Here, the client according to an embodiment of the inventive concept may determine whether the function of the virtual control panel is set for the sensor coordinates of the user input, when the sensor coordinates corresponding to the user input correspond to a sensor corresponding to the virtual control panel, and may generate an execution code for executing the corresponding function when the function of the virtual control panel is set.

Then, the client according to an embodiment of the inventive concept may transmit the determined function of the virtual control panel to the host (S70).

Next, the client according to an embodiment of the inventive concept may determine whether there is a request to terminate the provision of the virtual control panel (S80), and may terminate a process of providing the virtual control panel when there is a request to terminate the provision of virtual control panel.

In the meantime, as illustrated in FIG. 11, a process after a communication connection between the client, which is a golf mat with a plurality of sensors, and the host that is a golf simulator is described in more detail as follows.

First of all, in an idle state, the inventive concept may determine whether the sensing amount of a sensor unit is changed while a sensor is scanned by a sensor scan unit (S110).

Next, the inventive concept may compare whether a change of the sensing amount of the sensor unit is at a specific level, when the sensing amount of the sensor unit is changed (S120).

Next, the inventive concept may calculate x coordinate and y coordinate of the sensor when the change of the sensing amount of the sensor unit is at a specific level (S130).

Moreover, the inventive concept may determine whether the calculated coordinates correspond to predetermined coordinate information (S140).

Next, when the calculated coordinates do not correspond to the predetermined coordinate information, the inventive concept may store information about the sensing amount such that the sensing amount is utilized as sensor data, and may switch to an idle state (S180).

Next, when the calculated coordinates correspond to the predetermined coordinate information, the inventive concept may compare whether the sensor is included in a predetermined group (S150).

Here, when the sensor is not included in the predetermined group, the inventive concept may store information about the sensing amount such that the sensing amount is utilized as sensor data, and may switch to an idle state (S180).

Besides, when the sensor is included in the predetermined group, the inventive concept may determine an execution command with reference to predetermined function setting information (S160).

Next, the inventive concept may perform the determined execution command (S170).

As such, the inventive concept may provide user convenience such that a user continuously works out by conveniently operating various functions at a current location without movement, by communicating between a golf simulator and a golf mat capable of providing a virtual control panel, providing the virtual control panel, and performing functions of the virtual control panel corresponding to a user input.

The inventive concept may provide compatibility indicating that a connection to a golf simulator provided by a plurality of manufacturers is possible, by providing a physical control panel of a golf simulator as a virtual button on a golf mat and may set the location and function of the virtual button on the golf mat such that a separate production process and a design change are not needed.

Moreover, when communication with the golf simulator is connected, the set coordinates and function may be finally determined by recognizing identifiers to be exchanged.

According to an embodiment of the inventive concept, it is possible to provide user convenience such that a user continuously works out by conveniently operating various functions at a current location without movement, by communicating between a golf simulator and a golf mat capable of providing a virtual control panel, providing the virtual control panel, and performing functions of the virtual control panel corresponding to a user input.

The inventive concept may provide compatibility indicating that a connection to a golf simulator provided by a plurality of manufacturers is possible, by providing a physical control panel of a golf simulator as a virtual button on a golf mat and may set the location and function of the virtual button on the golf mat such that a separate production process and a design change are not needed.

Moreover, when communication with the golf simulator is connected, the set coordinates and function may be finally determined by recognizing identifiers to be exchanged.

The method according to an embodiment of the inventive concept may be implemented by a program (or an application) and may be stored in a medium such that the program is executed in combination with a server being hardware.

The above-described program may include a code encoded by using a computer language such as C, C++, JAVA, a machine language, or the like, which a processor (CPU) of the computer may read through the device interface of the computer, such that the computer reads the program and performs the methods implemented with the program. The code may include a functional code related to a function that defines necessary functions executing the method, and the functions may include an execution procedure related control code necessary for the processor of the computer to execute the functions in its procedures. Furthermore, the code may further include a memory reference related code on which location (address) of an internal or external memory of the computer should be referenced by the media or additional information necessary for the processor of the computer to execute the functions. Further, when the processor of the computer is required to perform communication with another computer or a server in a remote site to allow the processor of the computer to execute the functions, the code may further include a communication related code on how the processor of the computer executes communication with another computer or the server or which information or medium should be transmitted/received during communication by using a communication module of the computer.

The stored medium refers not to a medium, such as a register, a cache, or a memory, which stores data for a short time but to a medium that stores data semi-permanently and is read by a device. Specifically, for example, the stored media include, but are not limited to, ROM, RAM, CD-ROM, magnetic tape, floppy disk, optical data storage device, and the like. That is, the program may be stored in various recording media on various servers, which the computer may access, or in various recording media on the computer of the user. Further, the media may be distributed in computer systems connected over a network such that codes readable by the computer are stored in a distributed manner.

Steps or operations of the method or algorithm described with regard to an embodiment of the inventive concept may be implemented directly in hardware, may be implemented with a software module executable by hardware, or may be implemented by a combination thereof. The software module may reside in a random access memory (RAM), a read only memory (ROM), an erasable programmable ROM (EPROM), an electrically erasable programmable ROM (EEPROM), a flash memory, a hard disk, a removable disk, a CD-ROM, or a computer-readable recording medium well known in the art to which the inventive concept pertains.

Although an embodiment of the inventive concept are described with reference to the accompanying drawings, it will be understood by those skilled in the art to which the inventive concept pertains that the inventive concept may be carried out in other detailed forms without changing the scope and spirit or the essential features of the inventive concept. Therefore, the embodiments described above are provided by way of example in all aspects, and should be construed not to be restrictive.

While the inventive concept has been described with reference to embodiments, it will be apparent to those skilled in the art that various changes and modifications may be made without departing from the spirit and scope of the inventive concept. Therefore, it should be understood that the above embodiments are not limiting, but illustrative.

What is claimed is:

1. An apparatus for providing a virtual control panel, the apparatus comprising:

a host being a golf simulator; and a client being a golf mat on which a plurality of sensors are arranged, wherein the client includes:

a communication unit configured to communicate with the host;

a sensor unit configured to sense a user input for performing a function of the virtual control panel;

a storage configured to store sensor coordinates and a function, which correspond to the virtual control panel; and a controller configured to determine the function of the virtual control panel based on sensor coordinates corresponding to the user input, and wherein the controller is configured to:

when communicating with the host, provide identification information indicating the golf mat capable of providing the virtual control panel;

when an information request for the virtual control panel is received from the host, transmit predetermined sensor coordinates and function information of the virtual control panel;

transmit a notification that the virtual control panel is completely activated, to the host, by activating a sensor corresponding to the virtual control panel;

determine whether the sensor coordinates corresponding to the user input received from the sensor unit correspond to the sensor corresponding to the virtual control panel;

when the sensor coordinates correspond to the sensor corresponding to the virtual control panel, determine the function of the virtual control panel corresponding to the sensor coordinates; and transmit the determined function of the virtual control panel to the host.

2. The apparatus of claim 1, wherein, in the sensor unit, the plurality of sensors are arranged one-dimensionally or two-dimensionally on a mat plate, and wherein the plurality of sensors are a single sensor including one of a pressure-sensitive sensor, a capacitive sensor, a switch-type sensor, an electromagnetic induction sensor, and a near-infrared sensor or a composite sensor including two or more among the pressure-sensitive sensor, the capacitive sensor, the switch-type sensor, the electromagnetic induction sensor, and the near-infrared sensor.

3. The apparatus of claim 1, wherein the controller is configured to:

when providing the identification information, identify a communication connection with the host;

when the communication connection with the host is completed, determine whether the identification information indicating the golf mat capable of providing the virtual control panel is stored in the storage; and when the identification information is stored in the storage, obtain the identification information from the storage and allow the communication unit to transmit the identification information to the host.

4. The apparatus of claim 1, wherein the controller is configured to:

when transmitting the sensor coordinates and the function information of the virtual control panel, determine whether the information request for the virtual control panel is received from the host;

when the information request for the virtual control panel is received, determine whether the sensor coordinates and the function information of the virtual control panel are stored in the storage; and when the sensor coordinates and the function information of the virtual control panel are stored in the storage, obtain the sensor coordinates and the function information of the virtual control panel from the storage and allow the communication unit to transmit the sensor coordinates and the function information of the virtual control panel to the host.

5. The apparatus of claim 4, wherein the controller is configured to:

when transmitting the sensor coordinates and the function information of the virtual control panel, transmit, to the host, coordinate information about one sensor corresponding to the virtual control panel and setting function information of the one sensor; or transmit, to the host, a coordinate range including coordinate information of a sensor positioned at a start point and coordinate information of a sensor positioned at an end point, and setting function information corresponding to a corresponding sensor group among a sensor group including a plurality of sensors corresponding to the virtual control panel.

6. The apparatus of claim 1, wherein the controller is configured to:

when determining the function of the virtual control panel, determine whether the function of the virtual control panel is set for the sensor coordinates of the user input, when the sensor coordinates corresponding to the user input correspond to the sensor corresponding to the virtual control panel; and when the function of the virtual control panel is set, generate an execution code for executing a corresponding function.

7. The apparatus of claim 1, wherein the storage includes:

a transmission coordinate storage configured to store predetermined sensor coordinates of the virtual control panel;

a transmission function storage configured to store predetermined function information of the virtual control panel; and an identification code storage configured to store identification code indicating that the client is the golf mat capable of providing the virtual control panel.

8. The apparatus of claim 1, wherein the controller includes:

a coordinate comparison unit configured to compare the sensor coordinates of the user input with predetermined sensor coordinates of the virtual control panel;

an input coordinate detection unit configured to detect the sensor coordinates corresponding to the user input when the user input is received from the sensor unit;

a function matching unit configured to match the function of the virtual control panel to the sensor coordinates of the user input when the sensor coordinates corresponding to the user input correspond to the sensor corresponding to the virtual control panel; and a function code generation unit configured to generate an execution code for executing the corresponding function when the function of the virtual control panel is matched.

9. A method for providing a virtual control panel of an apparatus including a host being a golf simulator and a client being a golf mat on which a plurality of sensors are arranged, the method comprising:

when the client communicates with the host, providing, by the client, identification information indicating the golf mat capable of providing the virtual control panel;

when an information request for the virtual control panel is received from the host, transmitting, by the client, predetermined sensor coordinates and function information of the virtual control panel;

activating, by the client, a sensor corresponding to the virtual control panel and transmitting a notification that the virtual control panel is completely activated, to the host;

when a user input is received from the sensor, determining, by the client, whether the sensor coordinates corresponding to the user input correspond to the sensor corresponding to the virtual control panel;

when the sensor coordinates correspond to the sensor corresponding to the virtual control panel, determining, by the client, a function of the virtual control panel corresponding to the sensor coordinates; and transmitting, by the client, the determined function of the virtual control panel to the host.

10. The method of claim 9, wherein the providing of the identification information includes:

when providing the identification information, identifying, by the client, a communication connection with the host;

when the communication connection with the host is completed, determining, by the client, whether the identification information is stored in the storage; and when the identification information is stored in the storage, obtaining, by the client, the identification information from the storage and transmitting the identification information to the host.

11. The method of claim 9, wherein the transmitting of the sensor coordinates and the function information includes:

when transmitting the sensor coordinates and the function information of the virtual control panel, determining whether the information request for the virtual control panel is received from the host;

when the information request for the virtual control panel is received, determining whether the sensor coordinates and the function information of the virtual control panel are stored in the storage; and when the sensor coordinates and the function information of the virtual control panel are stored in the storage, obtaining the sensor coordinates and the function information of the virtual control panel from the storage and transmitting the sensor coordinates and the function information of the virtual control panel to the host.

12. The method of claim 11, wherein the transmitting of the sensor coordinates and the function information includes:

when transmitting the sensor coordinates and the function information of the virtual control panel, transmitting, to the host, coordinate information about one sensor corresponding to the virtual control panel and setting function information of the one sensor; or transmitting, to the host, a coordinate range including coordinate information of a sensor positioned at a start point and coordinate information of a sensor positioned at an end point, and setting function information corresponding to a corresponding sensor group among a sensor group including a plurality of sensors corresponding to the virtual control panel.

13. The method of claim 9, wherein the determining of the function includes:

when determining the function of the virtual control panel, determining whether the function of the virtual control panel is set for the sensor coordinates of the user input, when the sensor coordinates corresponding to the user input correspond to the sensor corresponding to the virtual control panel; and when the function of the virtual control panel is set, generating an execution code for executing a corresponding function.

14. A computer-readable recording medium storing a computer program in combination with a computer being a piece of hardware to execute a virtual control panel providing method in claim 9.

* * * * *